US008074379B2

(12) United States Patent
Robinson, Jr. et al.

(10) Patent No.: US 8,074,379 B2
(45) Date of Patent: Dec. 13, 2011

(54) SHOES WITH SHANK AND HEEL WRAP

(75) Inventors: Douglas K. Robinson, Jr., Mansfield, MA (US); John J. Erickson, Brockton, MA (US); John F. Lane, III, Weymouth, MA (US); Hetal Y. Dave, Framingham, MA (US)

(73) Assignee: Acushnet Company, Fairhaven, MA (US)

( * ) Notice: Subject to any disclaimer, the term of this patent is extended or adjusted under 35 U.S.C. 154(b) by 960 days.

(21) Appl. No.: 12/029,584

(22) Filed: Feb. 12, 2008

(65) Prior Publication Data

US 2009/0199435 A1 Aug. 13, 2009

(51) Int. Cl.
*A43C 11/00* (2006.01)
*A43B 23/00* (2006.01)

(52) U.S. Cl. ..... 36/50.1; 36/127; 36/108

(58) Field of Classification Search ..... 36/50.1, 36/50.5, 51, 108, 127
See application file for complete search history.

(56) References Cited

U.S. PATENT DOCUMENTS 4,811,500 A * 3/1989 Maccano ..... 36/91
5,371,957 A * 12/1994 Gaudio ..... 36/50.1
5,678,329 A * 10/1997 Griffin et al. ..... 36/50.1
5,692,319 A * 12/1997 Parker et al. ..... 36/50.1
5,732,483 A * 3/1998 Cagliari ..... 36/115
5,934,599 A 8/1999 Hammerslag
6,202,953 B1 3/2001 Hammerslag
6,289,558 B1 9/2001 Hammerslag
6,708,426 B2 3/2004 Erickson et al.
7,159,340 B2 * 1/2007 Borsoi ..... 36/50.1
7,661,205 B2 2/2010 Johnson
7,676,957 B2 3/2010 Johnson
7,793,435 B1 * 9/2010 Ruth ..... 36/50.1
2008/0052960 A1 * 3/2008 Belley et al. ..... 36/50.1
2009/0071041 A1 * 3/2009 Hooper ..... 36/3 A

* cited by examiner

*Primary Examiner* — Jila Mohandesi
(74) *Attorney, Agent, or Firm* — D. Michael Burns

(57) ABSTRACT

The present invention concerns a shoe (10) including an upper (12), having lateral and medial sides, a midsole (14) joined to the upper (12), and an outsole (16) joined to the midsole (4). Shoe (10) is tightened around the wearer's foot using a lacing system (18) comprising a lace (20) and tightening mechanism (22). Lace (20) is threaded through shank (24) positioned under the arch and heel wrap (26) and attached at opposite ends to tightening mechanism (22). In an advantageous aspect of the present invention, lace (18) is tensioned to draw shank (24) upwards and towards the arch of the foot. In order to support the foot, shank (24) is comprised of a material having a strain rate lower than the upper (12).

11 Claims, 4 Drawing Sheets

SHOES WITH SHANK AND HEEL WRAP

FIELD OF THE INVENTION

The present invention relates generally to shoes. More particularly, the present invention relates to golf shoes comprising a shank and heel wrap that are coupled to an automatic lacing system.

BACKGROUND OF THE INVENTION

There currently exist a number of mechanisms and methods for tightening a shoe or boot around a wearer's foot. A traditional method comprises threading a lace in a zigzag pattern through eyelets that run in two parallel rows attached to opposite sides of the shoe. The shoe is tightened by first tensioning opposite ends of the threaded lace to pull the two rows of eyelets towards the midline of the foot and then tying the ends in a knot to maintain the tension. A number of drawbacks are associated with this type of lacing system. First, laces do not adequately distribute the tightening force along the length of the threaded zone, due to friction between the lace and the eyelets, so that portions of the lace are slack and other portions are in tension. Consequently, the higher tensioned portions of the shoe are tighter around certain sections of the foot, particularly the ankle portions which are closer to the lace ends. This is uncomfortable and can adversely affect performance in some sports.

Another drawback associated with conventional laces is that it is often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions and sometimes much of the foot in tension even when the knot is released. Consequently, the user must often loosen the lace individually from each of the eyelets. This is especially tedious if the number of eyelets is high.

U.S. Pat. Nos. 5,934,599, 6,202,953, and 6,289,558 to Hammerslag (the "Hammerslag Patents"), which are incorporated herein by reference in their entireties, disclose a lacing system that automatically distributes lateral tightening forces along the length of the wearer's ankle and foot. More particularly, the Hammerslag Patents describe a circular tightening apparatus that is rotated to tighten stainless steel wire/strands coated with friction reducing polymers and locked in place with a ratchet and pawl lock. The polymer coated stainless steel wire is threaded through the eyelets around the ankle and is connected at both ends to the tightening apparatus. The stainless steel laces are loosened when the lock is released by lifting the pawl and pulling on the laces to loosen them, or using reverse rotation of the ratchet. This lacing system is known commercially as the BOA™ system, and the FootJoy ReelFit™ golf shoes have incorporated this lacing system. However, the footwear incorporating the lacing system disclosed in the Hammerslag Patents only supports the top of the foot and the ankle, and does not support the arches of the feet. Furthermore, the stainless steel lace disclosed therein can cause discomfort when it traverses through conventional padding in a shoe. Such shortcomings can diminish a wearer's athletic performance in sports such as golf, where it has been long recognized that proper foot support is the foundation to a powerful and consistent golf swing.

Thus, there is a need for a tightening system for footwear that does not suffer from the aforementioned drawbacks.

SUMMARY OF THE INVENTION

[to be completed after final approval of claims]

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE INVENTION

The present invention incorporates a cradle or shank and other modifications into a Hammerslag lacing system. The shank is substantially inelastic in order to distribute the tension when the lace is tightened, and has two upstanding members and a base to fit under the outsole proximate to the arch of the foot. The lace is threaded through both upstanding members of the shank, so that when the lacing system is tensioned, the tensioning force pulls the shank upward thereby providing additional support for the arch. In another modification, the lace is positioned away from the shoe padding to increase comfort to the wearer.

While the present invention is discussed in connection with golf shoes, it is understood that the inventive lacing system can be used in any footwear that employs a lacing system.

Figure 1:
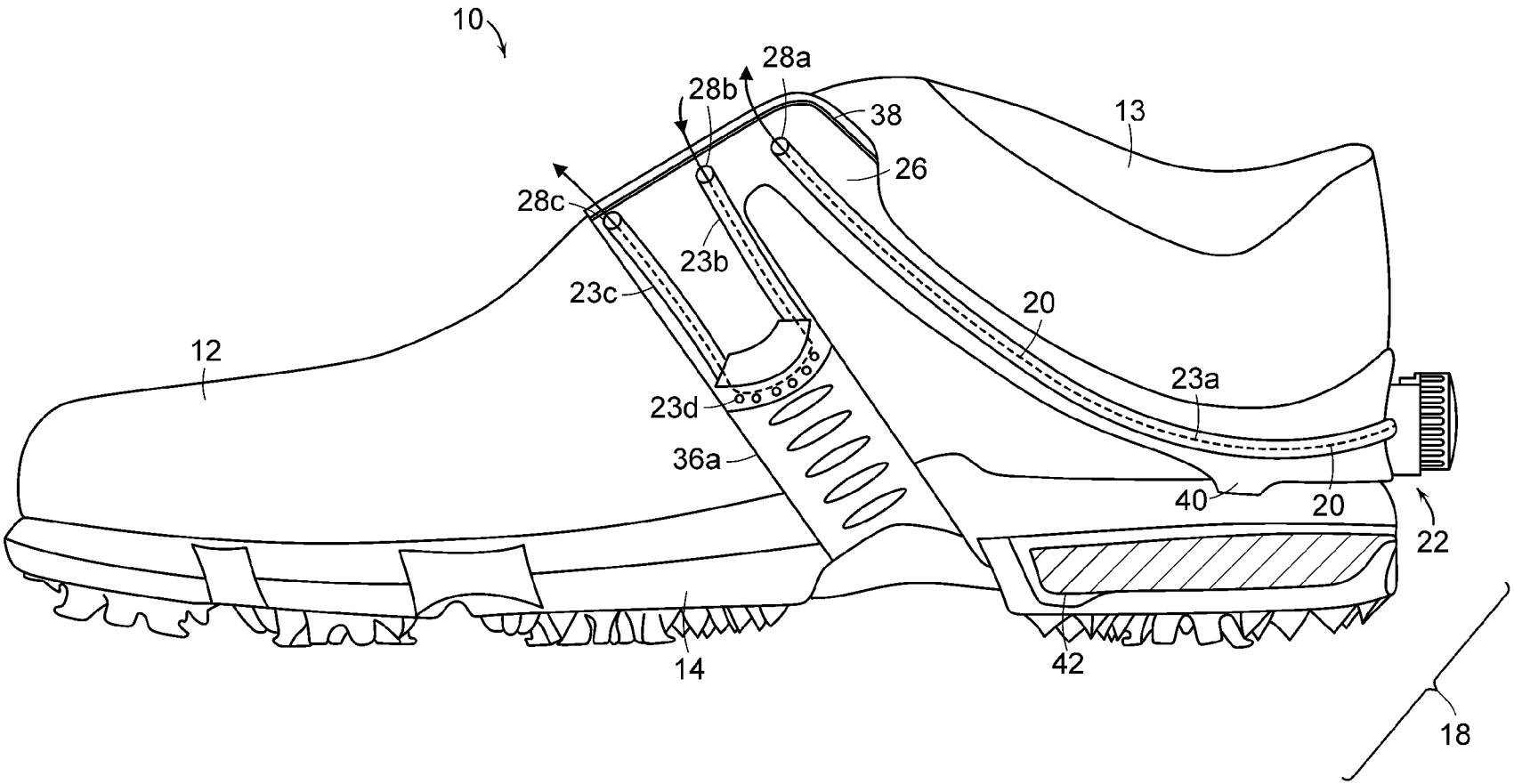
FIG. 1 is a side view of a lacing system for a golf shoe of the present invention.
Figure 2:
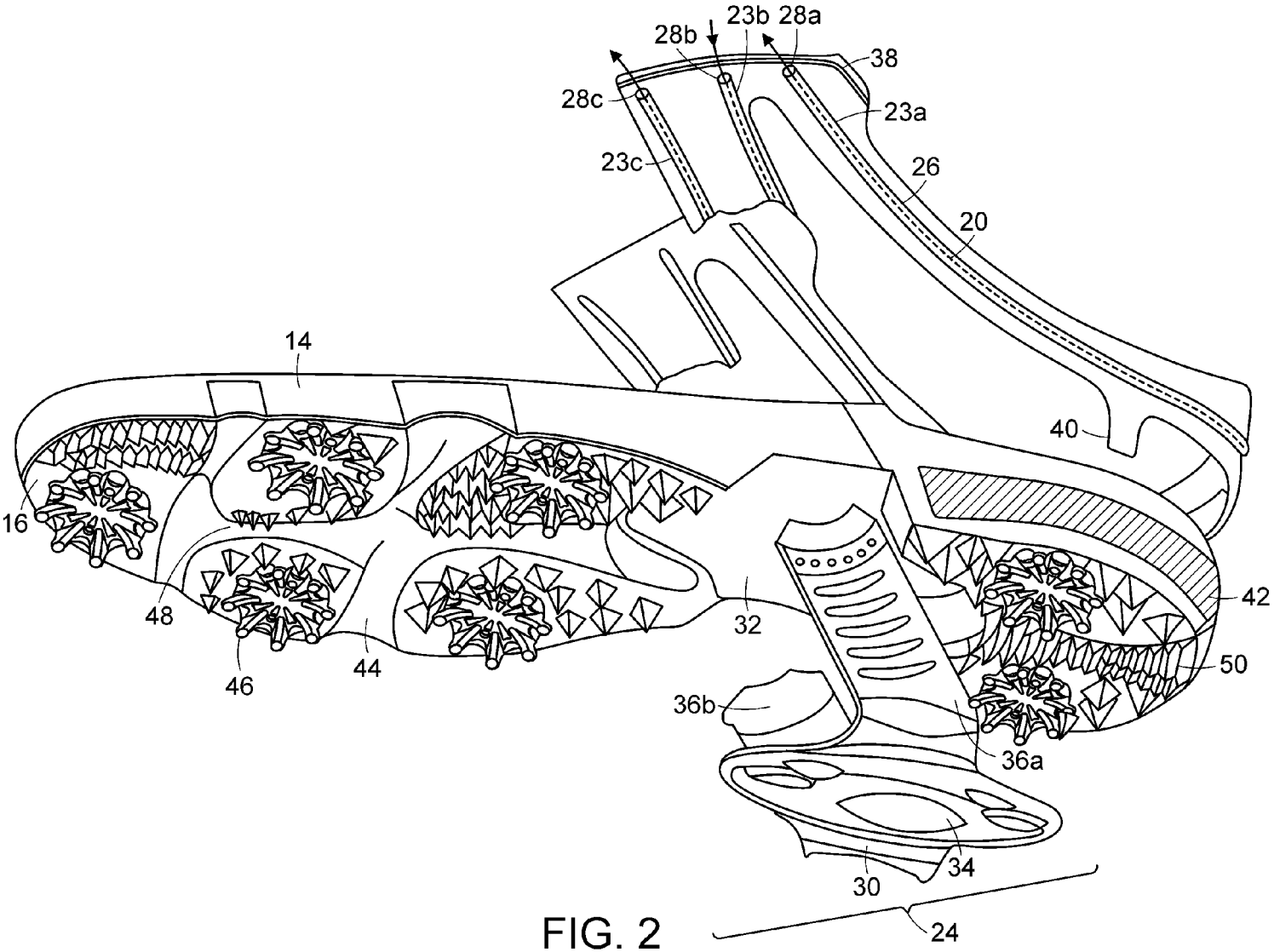
FIG. 2 is an exploded, bottom perspective view of an outsole of the golf shoe of FIG. 1.

FIGS. 1 and 2 illustrate a golf shoe 10 including an upper 12, a midsole 14 joined to the upper 12, and an outsole 16 joined to the midsole 14. Midsole 14 and outsole 16 form the sole of shoe 10. Shoe 10 is tightened around the wearer's foot using a lacing system 18 comprising a lace 20 and tightening mechanism 22. Lace 20 is preferably made from a substantially inelastic material, such as stainless steel wire or strands of wires, coated with a friction reducing material. Lace 20 is threaded through guides 23*a-d* in shank 24 (best shown in FIG. 2) and heel wrap 26, and attached at opposite ends to tightening mechanism 22. In an advantageous aspect of the present invention, lace 20 is tensioned to draw shank 24 towards the arches of the foot thereby providing stable support. In order to stably support the foot, shank 24 is comprised of a material having a relatively low strain rate such as, but not limited to, a thermoplastic polyurethane or a leather composite.

Referring back to FIG. 1, upper 12 has a generally conventional shape and is formed from a suitable upper material, such as leather, synthetic materials, or combinations thereof. An opening 13 is formed by the top portion of the upper 12 for receiving a user's foot. Upper 12 preferably has a lateral side and a medial side. Upper 12 is preferably secured to midsole 14 by stitching or with cement or other adhesives using an insole board and conventional techniques, as known by those of ordinary skill in the art.

The midsole 14 provides cushioning to the wearer, and is formed of a material such as an ethylene vinyl acetate copolymer (EVA). Preferably, the midsole 14 is formed on and about the outsole 16. Alternatively, the midsole can be formed separately from the outsole and joined thereto, such as by adhesive. Once the midsole and outsole are joined, they form a substantial portion of the bottom of shoe 10.

As shown in FIG. 1, shoe 10 is tightened around the wearer's foot using a lacing system 18 comprising a lace 20 and tightening mechanism 22. Although lacing system 18 can be any appropriate lacing system including traditional shoe lacing systems, in a preferred embodiment the present invention utilizes the BOA Lacing System™, commercially available from Boa Technology Inc. of Steamboat Springs, Colo. The specifics of the Boa Lacing System™ are further described in U.S. Pat. Nos. 5,934,599, 6,202,953, and 6,289,558 to Hammerslag (the "Hammerslag Patents"), which were previously incorporated by reference in their entireties. However, unlike the BOA™ system, lace 20 and guide 23*a* passes under the ankle padding to reduce discomfort to the wearer.

On both the lateral and medial sides of shoe 10, lace 20 (which is shown in phantom lines inside guides 23*a-d*) traverses from tightening mechanism 22 through guides 23*a-d*. Lace 20 is threaded through holes 28*a-c* in a cross pattern. In an advance over the existing art, lace 20 and guides 23*a-d* are coupled to shank 24 and heel wrap 26 in order to provide a better fit to the wearer. Both heel wrap 26, which is positioned under the ankle padding, and shank 24 advantageously cushion the wearer's foot from pressure resulting from lace 20. Heel wrap 26 comprises a lateral portion, an ankle portion that wraps around below the ankle and a medial portion. The lateral portion of wrap 26 overlies the lateral portion of upper 12 and the medial portion of wrap 26 overlies the medial portion of upper 12.

Lace 20 may be formed from any of a wide variety of polymeric or metal materials or combinations thereof, which exhibit sufficient axial strength and bendability for the present application. For example, any of a wide variety of solid wire cores, solid polymeric cores, or multi-filament wires or polymers, which may be woven, braided, twisted or otherwise oriented, can be used. A solid or multi-filament metal core can be provided with a polymeric coating, such as PTFE or others known in the art, to reduce friction. In one embodiment, the lace 20 comprises a stranded cable, such as a 7-strand by 7-strand cable manufactured of stainless steel. In order to reduce friction between the lace 20 and the guides 23*a-d* through which the lace 20 slides, the outer surface of the lace 20 is preferably coated with a lubricous material, such as nylon or Teflon®.

As shown in FIG. 1, the tightening mechanism 22 is mounted to the rear of the upper 12. Alternatively, tightening mechanism 22 may be located on the bottom of the heel of the shoe 10, on the medial or the lateral sides of the upper 12 or sole, as well as anywhere along the midline of the shoe facing forward or upward.

Each of the lace guides 23*a-d* has a tube-like configuration having a central lumen. The lumen has an inside diameter that is larger than the outside diameter of lace 20 to facilitate sliding of lace 20 through lace guides 23*a-d* and prevent binding of lace 20 during tightening and untightening. Further, lace guides 23*a-d* are preferably manufactured of a low friction material, such as a lubricous polymer or metal, that facilitates the slidability of the lace 20 therethrough. Alternatively, guides 23*a-d* can be made from substantially rigid polymers and be coated with an anti-friction material to reduce friction. It can also be made from leather, synthetic leather or a composite.

Lace 20 first runs from tightening mechanism 22 across lateral guide 23*a* located on heel wrap 26 and exits via eyelet 28*a* to the opposite side of the shoe. Subsequently, lace 20 enters from the opposite side of the shoe via eyelet 28*b* and traverses down longitudinal guide 23*b*. Next, lace 20 traverses around curved guide 23*c* located on cradle or shank 24 to connect shank 24 to the lacing system. Lace 20 then traverses up longitudinal guide 23*d* and exits via eyelet 28*c* to the opposite side of the shoe and the same lacing steps are repeated. The movement of lace 20 down, around, and up guides 23*b-d* is especially advantageous because such movement generates a tensional force that draws shank 24 towards the longitudinal and transverse arches of the foot thereby providing stable support. Such resilient support balances the wearer's stance during a golf swing. Moreover, stable support promotes podiatric health by helping to prevent common golfing pathologies including, for example, flat foot and foot fatigue, which can cause considerable discomfort during walking. Thus, the present invention helps to optimize a golfer's swing while allowing a golfer to walk normally and comfortably.

As best seen in FIG. 2, shank 24 is a unitary structure comprised of three distinct elements: base member 30 and upstanding members 36*a* and 36*b*. Base member 30 is shaped and sized to fit within a cavity 32 underlying the arch area in midsole 14. This base member 30 has a generally oblong shape and extends along the arch area. Advantageously, base member 30 provides a stable platform to support the longitudinal and transverse arches of the wearer's foot.

Because shank 24 is designed to provide stable support to the arch area, shank 24 is preferably manufactured from a material having a relatively low strain rate such as, but not limited to, a thermoplastic polyurethane or a leather composite. Preferably, the strain rate is less than about 50%, more preferably less than about 25% or less than about 10% or less than 5%. More particularly, it is preferable that shank 24 be comprised of a material having a strain rate lower than leather or a strain rate lower than that of upper 12, so that shank 24 deforms less than upper 12, thereby allowing shank 24 to reliably provide support to the wearer's arch area. In one embodiment of the present invention, shank 24 is comprised of a suitable thermoplastic polyurethane. In another embodiment of the present, shank 24 is comprised of a suitable leather composite. Preferably, one layer of the leather composite material is a non-stretch, non-woven fabric such as Tyvek® (strong yarn linear polyethylene), which is commercially available from E. I. du Pont de Nemours and Company of Wilmington, Del.

Shank 24 also comprises lateral upstanding member 36*a* and medial upstanding member 36*b*, which extend upward from outsole 16 and along upper 12. Upstanding members 36*a* and 36*b* house curved guide 23*c*, which as discerned above is sized and dimensioned to receive lace 20 to attach shank 24 to the lacing system. When lace 20 is tensioned, it draws shank 24 upward and base member 30 towards cavity 32 underlying the arch area, and helps interconnect upstanding members 36*a* and 36*b* to heel wrap 26, which are otherwise not necessarily attached to each other. This functionality of lace 20 represents another advancement over the art, because it obviates the need to use conventional adhesives or fasteners to connect either base member 30 to cavity 32, or upstanding members 36*a-b* to heel wrap 26. In another embodiment, base member 30 is attached to cavity 32 by cement or adhesive with upstanding members 36*a* and 36*b* remain unattached. Alternatively, upstanding members 36*a* and 36*b* are cemented to or stitched to upper 12.

In another advantageous aspect of the present invention, both heel wrap 26 and shank 24 cushion the wearer's foot from discomfort resulting from lace 20. Conventionally, as discussed in greater detail in the Hammerslag Patents mentioned above, laces are threaded through lace guides that are sewn to a suitable location on a piece of footwear. This manner of attaching the lace guides can introduce pressure points and irritation to the wearer's foot. The present invention solves this problem by placing lace guides 23*a-d* within heel wrap 26 and shank 24, which cushion the wearer's foot from the impact of lace 20.

Heel wrap 26 is formed from a thermoplastic polyurethane, and is free floating except at least two points. First, heel wrap 26 is stitched to upper 12 using a stitch groove 38, which helps to ensure that the stitches are evenly distributed. Second, heel wrap 26 comprises tab 40 that is lasted under midsole 14. Preferably, one tab 40 is used on each side of the shoe. Thus, both stitch groove 38 and tabs 40 help secure heel wrap 26 to shoe 10.

In addition to the innovative features discussed above, shoe 10 also comprises several other elements. For instance, as shown in FIGS. 1 and 2, a window member 42 formed of clear thermoplastic urethane can be located on the lateral side of midsole 14. A gel cushion (not shown) can be configured and dimensioned to fit within window member 42 in order to absorb shock during walking. Outsole 16 also comprises flexing channels 44 which provide good longitudinal flexibility and predetermined bend lines for comfort. Outsole 16 also includes a series of projections 46, 48, 50, commonly referred to as "spikes" and "cleats," which protrude from the bottom surface of outsole 16 in order to provide traction with the ground. Further information about window member 42, flexing channels 44, and projections 46, 48, 50 can be found in commonly held U.S. Pat. No. 6,708,426, which is incorporated herein by reference in its entirety.

Figure 3:
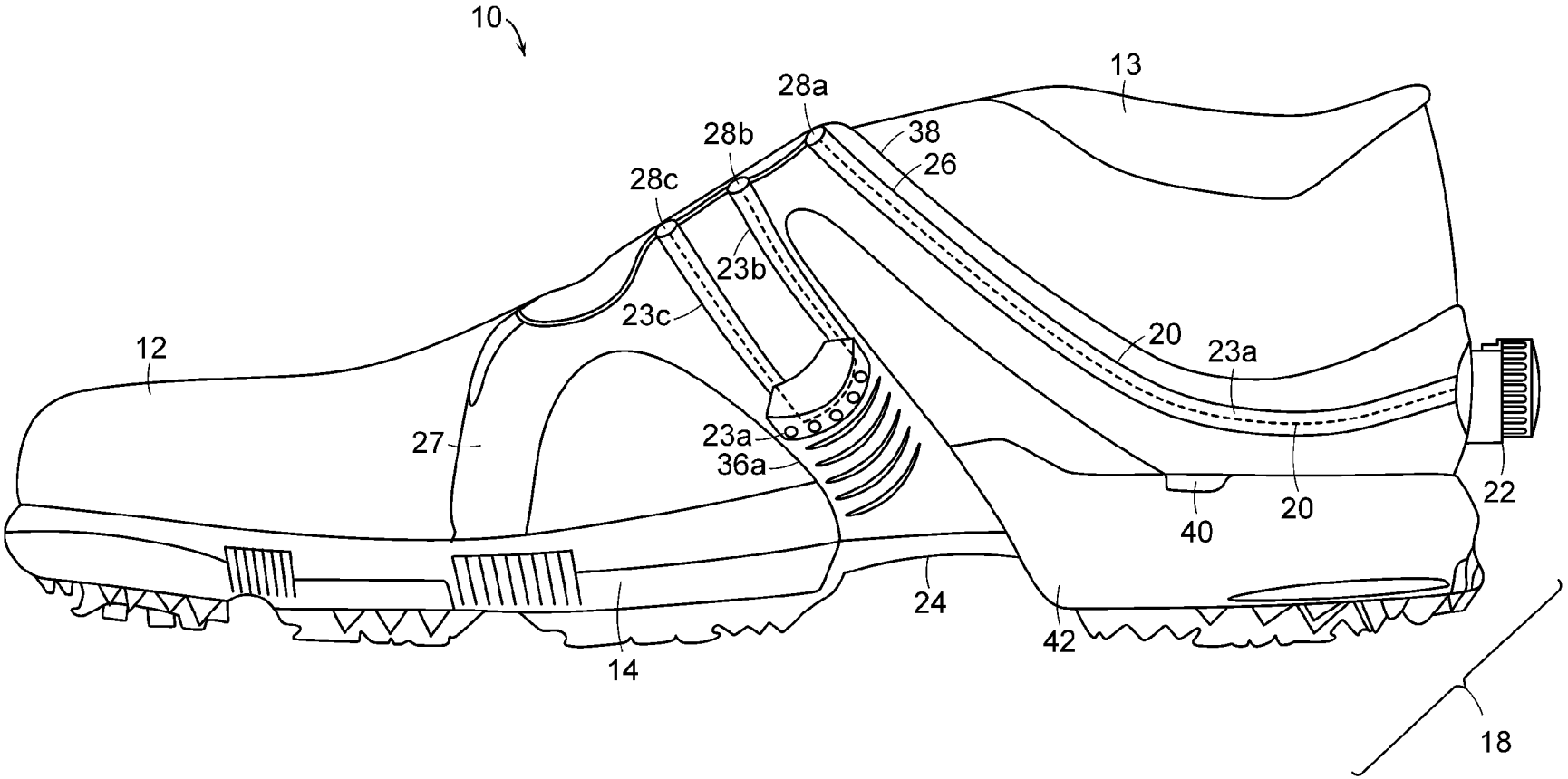
FIG. 3 is a side view of another embodiment
Figure 4:
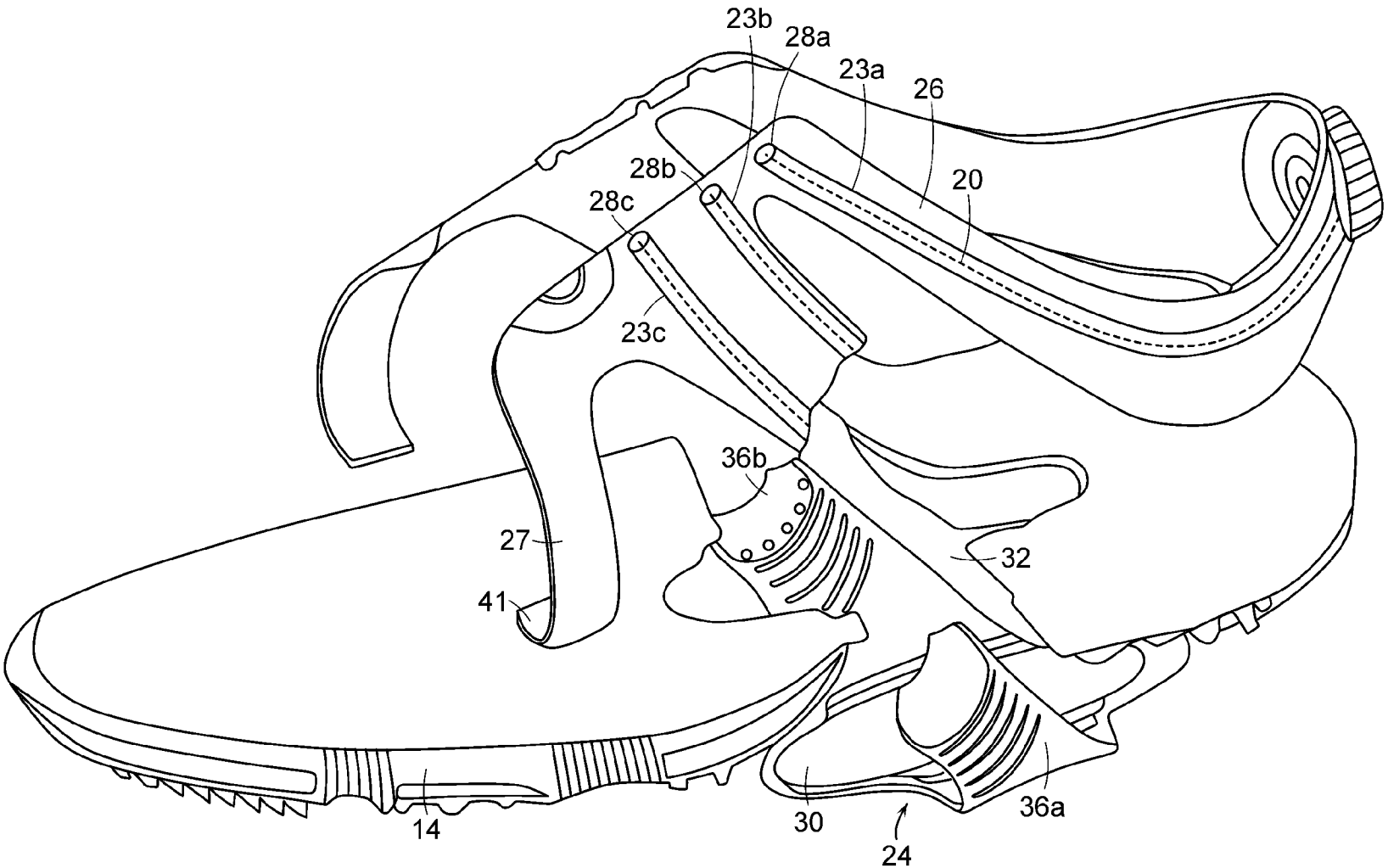
FIG. 4 is an exploded, perspective view of the golf shoe of FIG. 3

In another embodiment, additional support is added to lacing system 18. As shown in FIGS. 3 and 4, metatarsal support 27 extends lacing system 18 towards the front of shoe 10. In addition to the two locations, where heel wrap 26 is connected to shoe 10 at tabs 40 and stitch groove 38, a third connection is made at tabs 41, where metatarsal support 27 is attached to midsole 14. Tabs 41 are attached in a similar manner as tabs 40. Metatarsal support 27 comprises a lateral portion and a medial portion. The lateral portion of metatarsal support 27 overlies the lateral portion of upper 12 and the medial portion of metatarsal support 27 overlies the medial portion of upper 12.

The addition of metatarsal support 27 provides additional support to the wearer's ball of the foot. When lace 20 is tensioned, metatarsal support 27 draws the ball of the foot upward, similar to shank 24 discussed above. This gives the wearer a more balanced tightness in the shoe, creating less slippage at the front of the shoe and less slippage sideways giving the wearer greater comfort and reducing blisters. Another advantage of metatarsal support 27 is that it gives lacing system 18 more stability by adding another connection to midsole 14 at tabs 41, making it stronger.

While it is apparent that the illustrative embodiments of the invention disclosed herein fulfill the objectives of the present invention, it is appreciated that numerous modifications and other embodiments may be devised by those skilled in the art. For example, as stated above the shank/arch support described above can be used with traditional shoes, such as golf shoes, hiking shoes, orthopedic shoes, athletic shoes, etc. In these situations, shoe laces from one side of the upper can cross-over the top of the shoe to lace through guide 23 of shank 24 on the opposite side, so that when the lace is tightened shank 24 is pulled up to support the foot as described above. In another example, metatarsal support 27 can be connected to or be a part of shank 24.

Additionally, feature(s) and/or element(s) from any embodiment may be used singly or in combination with feature(s) and/or element(s) from other embodiment(s). Therefore, it will be understood that the appended claims are intended to cover all such modifications and embodiments, which would come within the spirit and scope of the present invention.

The invention claimed is:

1. A lacing system for a golf shoe comprising a sole and an upper having a lateral side and a medial side, said lacing system comprising:

a wrap, a shank having a unitary structure attachable to the wrap, and a lacing system;

the wrap having a lateral side overlying the lateral side of the upper, a medial side overlying the medial side of the upper, and an ankle portion connecting the lateral side of the wrap to the medial side of the wrap and wrapping about a wearer's ankle;

the shank is substantially inelastic and comprises three distinct elements, a bottom portion, a single lateral upstanding member and a single medial upstanding member, wherein the shank is sized and dimensioned to be positioned under the sole proximate to the arch of the wearer's foot;

the lacing system comprising a lace threading through guides in the wrap and the shank, wherein both ends of the lace are connected to a tightening mechanism incorporating a rotational device that upon tightening can be locked in place with a ratchet and pawl lock so that as the tightening mechanism tensions the lace, the lace pulls the shank toward the wrap to provide support to the wearer's foot; and a plurality of removable cleats protruding from a bottom surface of the sole.

2. The lacing system of claim 1, wherein the wrap comprises a plurality of first guides and the upstanding members of the shank each comprises a second guide, wherein the lace is threaded through the first and second channels guides to operatively connect the shank to the wrap.

3. The lacing system of claim 1, wherein the shank's strain rate is less than the upper's strain rate.

4. The lacing system of claim 3, wherein the shank's strain rate is about 50% less than the upper's strain rate.

5. The lacing system of claim 3, wherein the shank's strain rate is about 25% less than the upper's strain rate.

6. The lacing system of claim 3, wherein the shank's strain rate is about 5% less than the upper's strain rate.

7. The lacing system of claim 1, wherein the upper comprises padding around the wearer's ankle and the padding is spaced apart from the lace.

8. The lacing system of claim 1, wherein the wrap further comprises a metatarsal support.

9. The lacing system of claim 8, wherein the metatarsal support is located toward the front of the footwear.

10. The lacing system of claim 1, wherein the lace comprises a polymer coated metal wire.

11. The lacing system of claim 1, wherein the shank comprises a thermoplastic urethane or a leather composite.

* * * * *